United States Patent [19]

Gotham

[11] 4,000,860

[45] Jan. 4, 1977

[54] SIZE REDUCTION APPARATUS

[75] Inventor: Stanley T. Gotham, Somerset, Mass.

[73] Assignee: Leesona Corporation, Warwick, R.I.

[22] Filed: Nov. 13, 1975

[21] Appl. No.: 631,734

[52] U.S. Cl. ..... 241/242; 241/73; 241/222; 241/294

[51] Int. Cl.[2] ..... B02C 13/02

[58] Field of Search ..... 241/73, 221, 222, 224, 241/242, 285 B, 294

[56] References Cited

UNITED STATES PATENTS

| | | | |
|---|---|---|---|
| 2,830,770 | 4/1958 | DeLuca | 241/73 |
| 2,853,247 | 9/1958 | Anderson | 241/285 B X |
| 3,270,968 | 9/1966 | Hess et al. | 241/224 X |
| 3,378,210 | 4/1968 | Bambach | 241/294 |
| 3,419,223 | 12/1968 | Morin | 241/73 |

FOREIGN PATENTS OR APPLICATIONS

| | | | |
|---|---|---|---|
| 1,810,103 | 8/1969 | Germany | 241/222 |

*Primary Examiner*—Roy Lake
*Assistant Examiner*—Howard N. Goldberg
*Attorney, Agent, or Firm*—Robert J. Doherty

[57] ABSTRACT

The present disclosure relates to a size reduction apparatus such as a granulating machine of the type for cutting plastics and the like. The granulating machine includes a chamber provided with a driven rotor having a plurality of cutting elements mounted on the periphery thereof, each cutting element having in turn a plurality of spaced cutting knives. The cutting knives cooperate with stationary bed knives to comminute materials fed into the cutting chamber. The downstroke side of the cutting chamber is further provided with an access opening normally closed during cutting operations by a cover, which may be of particularly heavy slotted construction and which provides a backup surface for the material being comminuted. The disclosed granulating machine is particularly useful in comminuting large chunks of plastic material such as heavy purging, thick sheet and cast blocks. Machines of this type are designated as hog type granulators in the industry. Accordingly, the constructional configurations herein disclosed are particularly useful in hog type granulators. Specifically, the particular design enables the accomplishment of heavy granulating tasks without stalling and with relatively low power requirements.

6 Claims, 6 Drawing Figures

SIZE REDUCTION APPARATUS

BACKGROUND OF THE INVENTION

The present invention is directed to hog type granulating machines for the size reduction of heavy plastic parts. Devices of this general type are in common application through out the plastics industry but include a number of operational drawbacks which the novel present machine overcomes. One such operational drawback of prior art devices are their generally high power requirements. Efforts to reduce the power requirements of such machines have resulted in machines exhibiting a tendency to stall under heavy load. Accordingly, a desirable feature and object of the present invention is the use of rotor knives having spaced blade portions which are laterally offset from each other which in combination with other features as will be hereinafter more apparent combine to produce a device having low power consumption but yet one which avoids the stalling tendencies of the prior art devices.

Known constructions of rotor knife blades further exhibit a tendency to require periodic regrinding of their cutting edges to maintain sharpness. In many prior art devices such regrinding reduces the projecting portion of the rotor blade to either render the blades useless or require shims or other adjustment means to increase their outward extension so as to project outwardly from the rotor in a cutting pattern. Accordingly, a further object of the present invention is a blade construction configured so as to reduce the necessity of its readjustment relative to its supporting rotor portions and further provides a blade having a geometric configuration such that material passing thereacross hones an upper trailing edge of the blade so as to continuously provide a sharpening action upon the blade so as to greatly increase the amount of plastic material which can be granulated before the blade must be reground.

Still another object of the present invention is the provision of rotor knives so configured so as to eliminate hard to clean pockets or undercut portions in which material cut may be entrapped during cutting so as to reduce the cleaning down time of such machines and accordingly enhance their output.

Still another object of the invention is the provision of means to reduce the tendency of chunks of material being granulated from riding on top of the rotor and from being frequently thrown upwardly inside the chamber of the machine as is common in prior art devices so as to better enable the granulation of such smaller chunks of material, thus assuring more complete and more rapid granulation.

These and other objects of the invention that will become apparent in the foregoing description are accomplished by the provision of a granulator comprising a chamber, a generally cylindrical rotor mounted within a chamber for rotation about an axis, means for driving the rotor about the axis, cutting means comprising a plurality of knives affixed to the rotor and situated in cutting relation with bed knives as the rotor is driven to effect reduction of material fed into the chamber. The rotor is provided with a plurality of partially cutout portions forming the seats for individual rotor knives having a plurality of outwardly extending spaced blade portions which may be mounted in combination with continuous knives alternating therewith and wherein the downstroke portions of such chamber is provided with a material backup portion or support either of a continuous surface or having a plurality of vertically orientated slots. The support sections serve to force plastic material to be cut, to be shifted arcuately higher on the rotor so that the impact of the blades contacts such material in a more horizontal direction than in prior art devices. The plurality of spaced vertical slots reduces the tendency for partially granulated material to bounce within the chamber.

The granulating machine of the present invention is further provided with particular cutting blade geometry having a trailing edge and exhibiting a hook-shaped face portion including a downwardly inwardly directed face edge which serves to provide a pocket for partially severed material and which further enables the drawing of material being cut across said trailing edge so as to longer maintain an effective cutting edge on the blade.

Other objects and features of the invention become more apparent by reference to the following drawings and detailed description of the invention.

DESCRIPTION OF THE INVENTION

Figure 1:
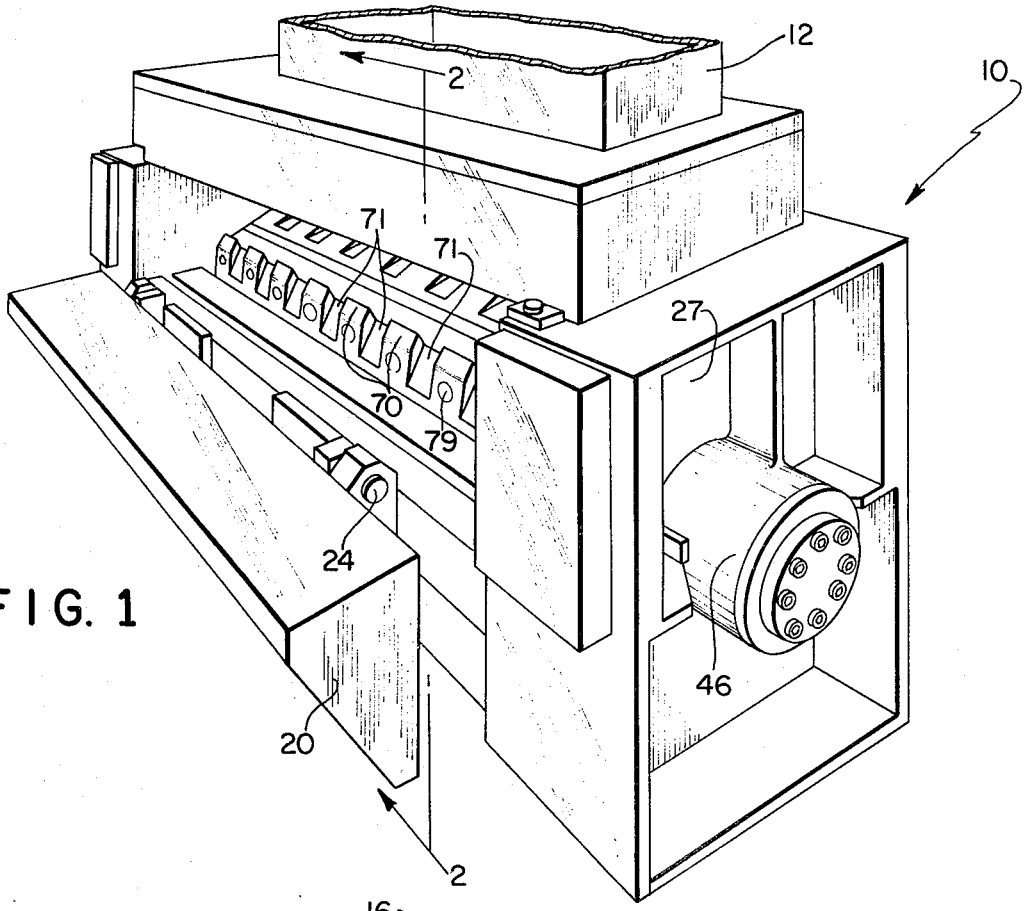
FIG. 1 is an overall perspective view of a hog type granulating machine embodying the features of the present invention.
Figure 2:
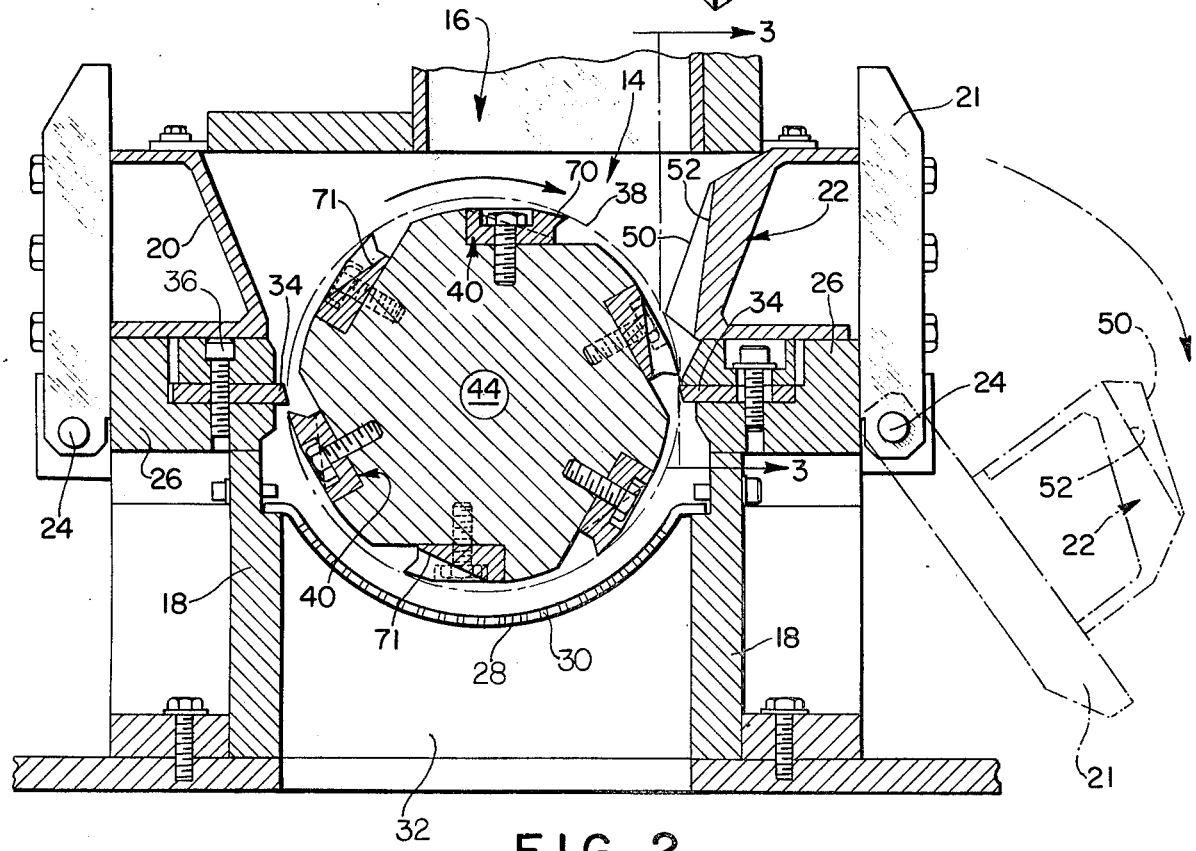
FIG. 2 is a side sectional view of the device taken along the line 2—2 of FIG. 1.
Figure 3:
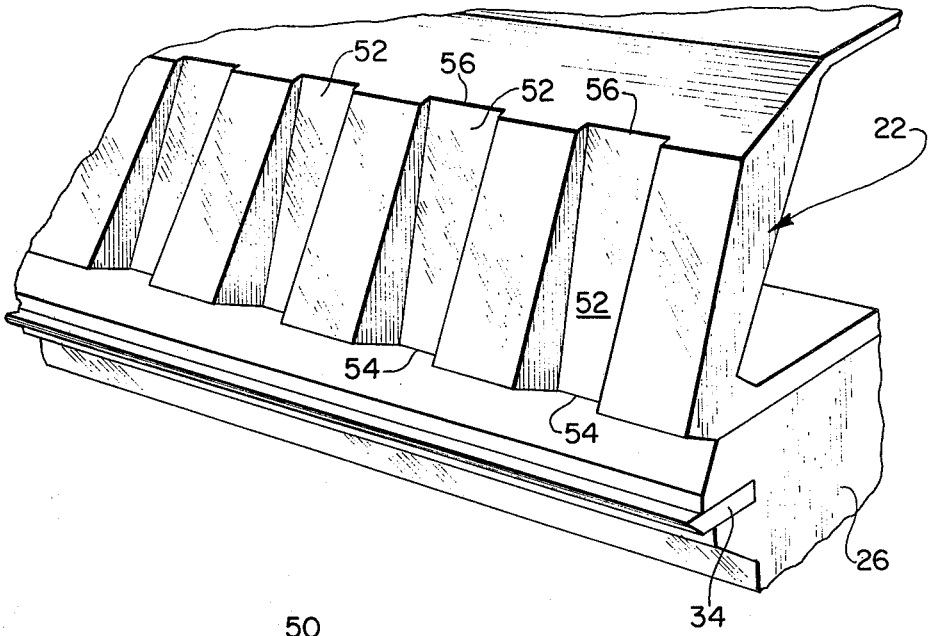
FIG. 3 is an enlarged perspective view of a portion of the present device, namely the material back up chamber.

Turning now to the drawings and particularly FIGS. 1 and 2 thereof, there is shown a hog type granulator identified by the reference numeral 10. This granulator may be the same as that manufactured and sold by Cumberland Engineering Company, Inc., South Attleboro, Mass., as its hog type series H model 37-H granulating machine. Granulator 10 includes the usual hopper 12 into which heavy plastic material such as purgings and the like are fed to the cutting chamber 14 via the opening 16. The chamber 14 has a relatively heavy base or frame 18 which forms the lower region of the cutting chamber 14. The cutting chamber 14 is also defined by opposed walls 20 and 22 of heavy metal fabrications which may be and preferably are in the form of doors 21 pivoted about heavy shafts 24 so that the direct access to the cutting chamber 14 is available both on the upstroke and downstroke sides of the rotor as will be better explained hereinafter. The chamber 14 is also enclosed by opposed heavy metal sidewalls one of which is shown at 27 in FIG. 1. The lower end of cutting chamber 14, further defined by a screen 28 which has a plurality of screen holes or openings 30 of a predetermined size therethrough, the size being determined by the size of particulate which will be permitted to be discharged from the cutting chamber 14. The particulate granulated within cutting chamber 14 is permitted to move outward from the cutting chamber through holes 30 and be discharged downwardly through a confined throat 32.

Within cutting chamber 14 there is also mounted a pair of oppositely disposed bed knives 34 which are rigidly fixed in lower wall segments 26 by suitable bolt means 36 as best seen in FIG. 2. The wall segments 26 in turn serve to support the walls 20 and 22 respectively as depicted. The forward end of each bed knife is arranged in close proximity to the cutting circle, identified by the broken line 38 in FIGS. 2,4 and 6 and a plurality of rotor knives 40 secured on the outer periphery of a rotor 42. Rotor 42 is mounted for rotation about an axis constituted by a pair of relatively heavy stub shafts 44 extending from opposite ends of the rotor and being suitably engaged in pedestal bearings 46 (see FIG. 1) held in the opposite sidewalls 27. Rotor 42 is suitably driven by means such as an electric motor (not shown).

It will be understood that material delivered into cutting chamber 14 through hopper 12 encounters the cooperative cutting action of bed knives 34 and rotor knives 40, the material passing into the lower portion of the cutting chamber 14 i.e., that portion of the cutting chamber lying below the opposite bed knives 34. When the material is reduced in size to a degree sufficient to pass out through the openings 30 in screen 28 it falls through throat 32 and received in by suitable conveyor means (not shown).

Figure 4:
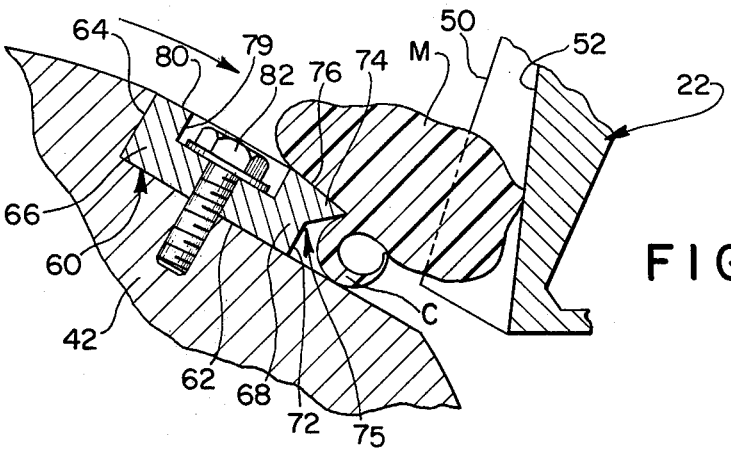
FIG. 4 is a partial sectional view on an enlarged scale showing the cutting action of the blade face into material to be granulated in a particular manner in which the hook blade configuration of the present invention comprises a pocket for small material portions severed from larger material chunks being acted upon by the device.

As is best illustrated in FIG. 2 and 4 of the drawings, the configuration of the door 21 on the downstroke side of the rotor 42 is best shown. Therein wall 22 is attached thereto by conventional means such as welding and is depicted as forming a backup surface for supporting material to be engaged by the knives 40. The surface of the wall 22 may be smooth but is preferably provided with a plurality of inwardly projecting segments 50 each separated by a vertically orientated slot 52. It should be noted that terminal portions of the segments 50 extend to within a short distance of the cutting circle or arc 38 and that such segments are positioned above the downstroke bed knife 34 and somewhat slightly to the left thereof as depicted in FIG. 2 of the drawings. The resultant material back up surface whether smooth or slotted is located closer to the vertical center line of the rotor than in conventional granulator constructions. This construction enables material to be engaged by the rotor knives 40 to be positioned higher on the rotor, that is, nearer to the top thereof which is in turn positioned directly beneath the hopper 12. This enables the primary cutting of material M to be engaged by the knives 40 in a more horizontal as contrasted to a vertical cutting position. Such primary cutting engagement of material thus occurs further up on the rotor in an arcuate direction away from the cutting downstroke wherein the rotor knives push the material against the wall 22 rather than allowing cutting further down towards the bed knife 34 wherein the knives as in a conventional construction would engage the material in a more vertically disposed downward direction whereby a wedging action between the knives, the material and the backup surface occurs. Such a wedging action would force the knives to take larger bites into the material and accordingly increase the power required at such re-occurring intervals during granulation. The present configuration enables a more minimum cut to be taken from the material and reduces the distance over which the rotor knives engage the material. Such reduced time of rotor knife travel through the material to be granulated means that there are fewer knives cutting at any given moment and accordingly more time available to restore energy to the rotating rotor mass and thus requiring less power consumption than in conventional granulating constructions.

Furthermore the slots 52 enable chunks of material as they become smaller during granulation to enter thereinto and drop to a lower and more conventional cutting position in the cutting chamber between the elements 50. In such position the rotor knives engage such smaller chunks with a more vertically pronounced downwardly cutting action which results in more rapid and complete granulation thereof. Although this action also increases the power requirements as to such smaller chunks of the material, the overall net effect is one of reduced power requirements since the larger masses of material which would require high peak loads of power are engaged by the rotor knives 40 in a more efficient manner from the power requirement standpoint. The slotted configuration of the backup surface or wall 22 also prevents small chunks of material from riding on top of the rotor and bouncing around within the chamber 14 especially since the upper portions of the slot 52 may be inwardly directed i.e. the slots 52 being wider at the bottom 54 thereof than at the top 56.

Figure 6:
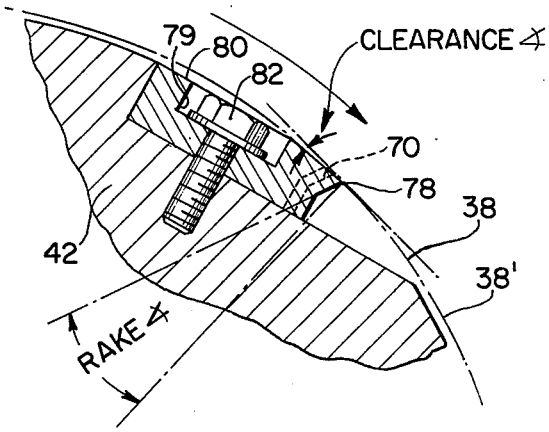
FIG. 6 is an enlarged view of the blade construction and mounting of the present invention wherein the particular hook shaped blade configuration depicted when worn the same amount as that shown in FIG. 5 does not exhibit such reduced cutting arc or path.

The configuration of the rotor knives 40 is best shown by reference to FIGS. 4 and 6 of the drawings wherein the rotor is provided with a plurality of partial cutout portions each extending along a chord thereof and spaced about the periphery thereof. The cutouts 60 each form a seat having a flat base portion 62 along the chord and an upstanding shoulder 64 at the inner terminus thereof for abutting receipt of a rotor knife 40. Each such rotor knife includes a continuous heel portion 66 adapted for abutting receipt with the seat shoulder 64 and a base portion 68 for engagement with the base 62 of the rotor. A plurality of hook shaped blades 70 are provided on said rotor knife 40 at longitudinally spaced locations; each such blade 70 being interrupted by slots 71. Each blade has a base portion including a lower section 72 of upright configuration that is generally normal to the base portion 62 of the cutouts 60 and upper section 74 extending upwardly and outwardly therefrom so as to form a hooked configuration exhibiting a material receiving pocket 75.

The pocket 75 is adapted for receipt of small material curls C cut from the main material body M. After the pocket is filled by a curl, the curl exerts an upward force against the main body of material M as best shown in FIG. 4 so as to reduce the thickness of the chip or curl as the blade completes the cut further reducing the power requirements of the device. This nibbling type cutting action further prevents large chunks of material from entering the lower chamber area where they could contact the screen and thus reduces the chance of potential equipment i.e. screen damage, which can occur with prior art devices. This is particularly helpful when granulating pipe. Additionally, such curl formation and nibbling cutting action brought about by the hook shaped blade face and particularly the lower generally vertical face surface 72 thereof serves to additionally prevent material being granulated from entering into the interface between the rotor knife and the rotor.

Figure 5:
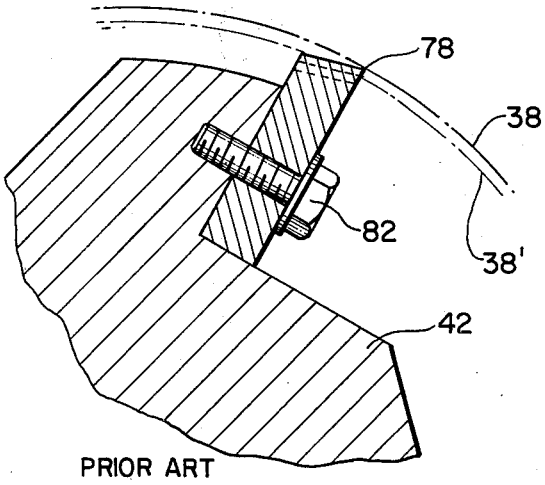
PRIOR ART FIG. 5
FIG. 5 is an enlarged view of a prior art blade having a straight face configuration and conventionally mounted, which when worn, rapidly produces a reduction in the cutting arc produced by the outer edge of the blade extending beyond the periphery of the rotor.

The upper part of each blade 70 is provided with a trailing edge 76 extending downwardly and angularly to its connection with the upper blade section 74. The geometry of the cutting blade of the present device is such that when progressive sharpening grinds are made as shown by the spaced dotted lines in FIG. 6 as distinguished from the progressive cuts similarly represented in the prior art blade configuration shown in FIG. 5 less reduction of effective cutting arc occurs. Each blade configuration has a cutting point 78 which projects outwardly from the rotor and initially determines the cutting arc 38. Since the trailing edge 76 of the blade 70 tends to approximate such arc more closely than the more pronounced point of prior art blades, progressive grinding of the present blade construction does not reduce the effective cutting by the pronounced amount shown by arc 38′ in FIG. 5. As may be seen, secondary arc 38′ of the FIG. 6 construction more closely approximates the original arc 38 thereof. The configuration of the blade edge above described is such that the material being cut passes across the blade and particularly the trailing edge 76 thereof, the material hones upper portions of the blade edge thereby producing a sharpening action. Such latter action also increases the amount of material which can be granulated before the knives must be reground.

Disposed behind each blade 70 is a counterbore 79 in the top surface 80 of the knife 40 for receipt of bolt means 82 in threaded contact with the rotor 42 to fix the rotor knife 40 thereto at a plurality of spaced locations, generally approximating the number of blades 70. The positioning of the bolt means 82 directly behind each blade 70 assures that the force necessary to hold the knives within their pockets is placed at those points which receive the maximum amount of thrust from the material being granulated. Furthermore the position of the rotor knives 40 directly against the shoulder 64 which is an integral part of the rotor 42, enables a large percentage of the cutting force applied to the blades and thus the knives, to be transmitted directly to the rotor which minimizes the load on the rotor knife retaining bolt means 82.

The slots 71 in combination and with the upwardly projecting blades 70 present a rotor knife configuration which eliminates blade mounting pockets and accordingly hard to clean material entrapping areas which can occur with individually mounted blades. Such slotted configuration enables the material to move both radially and lengthwise of the knives to present a smooth flow of material thereacross. It should be brought out that such rotor knives having spaced blades may be utilized in combination with continuous knives when peak power consumption considerations are not paramount as in the granulation of materials in sheet and rod form.

The upper portion 74 of the blade 70 is disposed at an angle defined as a rake angle to a plane passing through the center of the rotor and the cutting tip 78 of the blade 70. Also the trailing edge 76 of the blade 70 is disposed at an angle defined as a clearance angle to a plane normal to said previously described plane and also further passing through said cutting tip 78. Experimentation has shown that disposition of the trailing edge 76 at a clearance angle of approximately 10° enables material being cut to be dragged across a trailing edge 76 and thus hone or sharpen the blade 70 as the machine granulates material and that disposition of the blade surface 74 at a rake angle of approximately 20° enables the pocket 75 to receive material curls C which in turn exhibit the upward bite limiting force previously described.

It should be understood that the variations and modifications and special adaptations of the embodiments of the present invention shown may be utilized without departing from the scope of the present invention as set forth in the following claims.

I claim:

1. A granulator for size reduction of plastic material including heavy parts such as purgings and the like comprising, a chamber, a generally cylindrical rotor mounted within said chamber for rotation about an axis, means for driving said rotor about said axis, cutting means comprising a plurality of knives affixed on said rotor, a bed knife situated for cooperative cutting relationship with said rotor knives as said rotor is driven to effect size reduction of material fed into said chamber, said rotor having a plurality of partial cut out portions each extending along a chord and spaced about the periphery thereof, each of said cut out portions extending continuously along a major portion of the axis thereof and forming an uninterrupted seat having a flat base portion along said chord and an upstanding shoulder portion at the inner terminus thereof for abutting receipt of a rotor knife, each said rotor knife having a continuous heel and base portion and a knife face portion opposite said heel portion, the knife face of at least some of said rotor knives having a plurality of integral spaced blades and bolt means for maintaining said heel portion of said rotor knife against said shoulder portion of said seat and said base portion of said knife against said base portion of said seat, wherein said rotor knife includes a plurality of depressions provided in a top surface of said knife opposite said base portion of said knife, behind each blade thereof for receipt of said bolt means.

2. The granulator construction of claim 1, said chamber having a heavy wall portion comprising a back up surface on the downstroke side of said rotor for supporting bodies of plastic material being cut by said blades, said back up surface having in turn a plurality of spaced vertically orientated slots disposed above said bed knife means and inwardly directed towards and proximate to but spaced from the path of said hooked blades, said slots disposed generally opposite said blades.

3. The granulator construction of claim 2, said slots being wider at the bottom proximate said blade path for ease in receipt of said plastic material.

4. A granulator for size reduction of heavy plastic parts such as purgings and the like comprising a chamber for receiving material to be granulated, a rotor mounted within said chamber for rotation about an axis, cutting means affixed to and projecting from the periphery of said rotor, bed knife means situated for cooperative cutting relationship with said rotor cutting means as said rotor is driven to effect size reduction of material fed into said chamber, said chamber having a heavy wall portion comprising a material back up surface on the downstroke side of said rotor having in turn plurality of spaced vertically orientated slots disposed above said bed knife means and inwardly directed towards but spaced from the path of said rotor.

5. The granulator construction of claim 4, said cutting means disposed opposite said slots of said back up surface.

6. The granulator construction of claim 4, said chamber having an opening for interior access thereto positioned on the downstroke side of said rotor, said heavy wall portion mounted for pivotal movement towards and away from said chamber for closing said opening during operation of said granulator.

* * * * *